US007543963B2

(12) United States Patent
Bernard et al.

(10) Patent No.: US 7,543,963 B2
(45) Date of Patent: Jun. 9, 2009

(54) MODULE FOR PROJECTING A LIGHT BEAM

(75) Inventors: Stefano Bernard, Orbassano (IT); Piermario Repetto, Orbassano (IT); Denis Bollea, Orbassano (IT)

(73) Assignee: C.R.F. Societa' Consortile per Azioni (IT)

( * ) Notice: Subject to any disclaimer, the term of this patent is extended or adjusted under 35 U.S.C. 154(b) by 106 days.

(21) Appl. No.: 11/681,009

(22) Filed: Mar. 1, 2007

(65) Prior Publication Data

US 2007/0211486 A1 Sep. 13, 2007

(30) Foreign Application Priority Data

Mar. 2, 2006 (EP) ..... 06425137

(51) Int. Cl.
*F21V 7/00* (2006.01)

(52) U.S. Cl. ..... 362/297; 362/518

(58) Field of Classification Search ..... 362/296, 362/297, 545, 516–518, 303
See application file for complete search history.

(56) References Cited

U.S. PATENT DOCUMENTS

| | | | | |
|---|---|---|---|---|
| 4,953,063 | A * | 8/1990 | Nino | 362/539 |
| 2003/0202359 | A1* | 10/2003 | Albou | 362/514 |
| 2005/0219856 | A1 | 10/2005 | Tatsukawa | |
| 2006/0083005 | A1* | 4/2006 | Sokolov et al. | 362/341 |
| 2007/0171665 | A1* | 7/2007 | Finch | 362/516 |

FOREIGN PATENT DOCUMENTS

| | | | |
|---|---|---|---|
| EP | 1 418 381 | A2 | 5/2004 |
| EP | 1 596 125 | A | 11/2005 |

* cited by examiner

*Primary Examiner*—Jong-Suk (James) Lee
*Assistant Examiner*—Julie A Shallenberger
(74) *Attorney, Agent, or Firm*—Cook Alex Ltd.

(57) ABSTRACT

A module for projecting a light beam comprises: a light source suitable for producing the light beam, a substantially flat support surface on which the source is arranged in a manner such as to emit the light beam from only one side of the surface, and a curved reflecting surface which extends on one side of the support surface and has its concavity facing towards the support surface, and which is capable of reflecting the light beam originating from the source in a principal direction substantially parallel to the support surface of the source, the reflecting surface being divided into a plurality of reflecting areas suitable for receiving respective portions of the light beam. The plurality of reflecting areas comprises at least one area such that the portion of the light beam reflected by that area is substantially collimated in a vertical direction and has a small horizontal divergence $\alpha$ less than a first predetermined angular value $\alpha_1$, and at least one area which is designed in a manner such that the portion of the light beam reflected by that area has a wide horizontal divergence $\alpha$ greater than a second predetermined angular value $\alpha_2$. The area with wide horizontal divergence has a substantially elliptical horizontal cross-section parallel to the flat support surface with one of its foci substantially coinciding with the source and a substantially parabolic vertical cross-section with an axis substantially parallel to the flat support surface and with its focus substantially coinciding with the source.

17 Claims, 14 Drawing Sheets

MODULE FOR PROJECTING A LIGHT BEAM

Figure 1A:
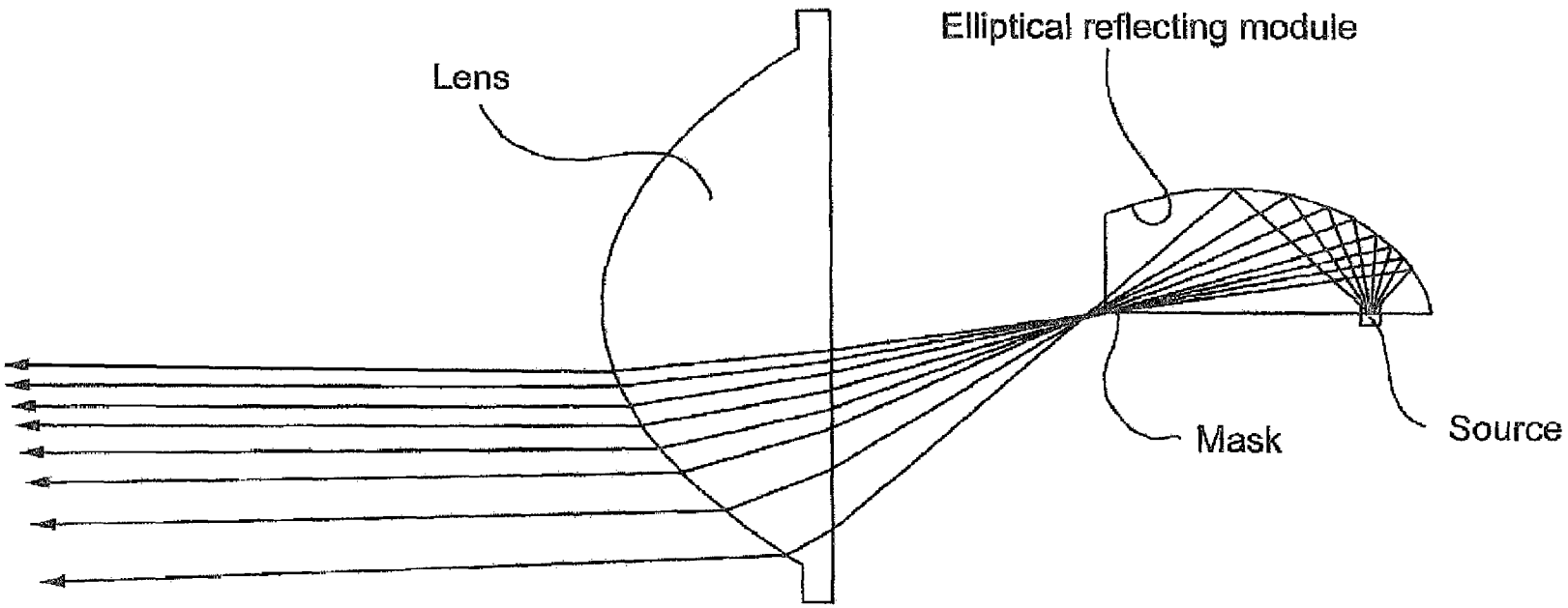

The present invention relates to a module for projecting a light beam having the characteristics defined in the preamble to claim 1.

Novel solutions have been under investigation in the automotive field for some time for the construction of front and rear vehicle lights formed by matrices of LEDs (an acronym which stands for "light-emitting diodes") or other light-emitting devices so as to obtain devices that are more compact, particularly in terms of depth, and have novel aesthetic content.

As is known, conventional headlamps are based on a halogen or discharge lamp source and an optical system which can form a light distribution or pattern in accordance with the norms that are in force. In the literature, there are many examples of optical arrangements suitable for forming a predetermined pattern, for example, that relating to the dipped-beam function, and based on the use of semiconductor sources. Two significant cases are cited below: Valeo's US2003/202359 and Koito Manufacturing Co.'s EP1418381 (FIG. 1). In both cases, the optical arrangement used is composed of:

a) an elliptical reflecting module at the primary focus of which the semiconductor source is positioned, b) a mask or in any case a surface portion which is suitable for blocking some of the rays emerging from the elliptical reflecting module to define the so-called cut-off (see definition in the following pages), which is positioned at the secondary focus of the elliptical reflector, and c) a lens having its primary focus coinciding with the secondary focus of the elliptical module.

There are substantially two difficulties relating to this configuration:

1. poor total efficiency of the system due to the fact that some of the light is blocked by the mask,
2. difficulty in the alignment of the optical system and in particular in the positioning of the masks with a consequent reduction in mechanical tolerances and increase in costs.

The optical arrangement of the present patent is intended to overcome these difficulties by means of a radical simplification of the optical chain which is composed solely of the reflecting module, with consequent elimination of the mask and the refractive element.

The single semiconductor source (for example, of the LED type) has a lower luminous flux than a halogen or gas-discharge source. As a result, it is necessary to use a plurality of semiconductor sources to achieve the performance of a headlamp based on those sources (in terms of flux on the road). There are two alternatives:

a) single optics and multiple sources, b) multiple module/source systems.

The first solution consists substantially of the replacement of the conventional single source with a cluster of semiconductor sources packed as close together as possible (to maximize luminance and reduce lamp dimensions), and then the design of an optical system that is optimized for this type of modular source. The main difficulty consists of the thermal control of the sources that are packed so closely together since the performance of the sources is considerably reduced unless an adequate system is used to dissipate the heat generated.

The second solution consists of the use of a plurality of distinct optical systems each having its own source. The patterns generated by each optical system may be different so that to have all of the devices switched on is a necessary condition for achieving the whole pattern and flux; alternatively, the patterns may be identical (modular solution) so that the single module produces the entire pattern but it is necessary to switch on all of the modules provided to reach the required flux. The modular solution is more advantageous because it is more adaptable to stylistic requirements and to technical development (particularly in terms of flux) of the semiconductor sources. However, the need to arrange a plurality of modules side by side to create the single function (for example, fog lamp or dipped beam) may give rise to problems of mutual interference between the modules, particularly when stylistic needs require the function to be accommodated at greatly curved points of the bodywork; the beam emerging from the outlet opening of a module may be partially concealed by the adjacent module, with a consequent deterioration of the pattern as a whole.

The object of the present invention is to solve the problem of mutual interference between distinct optical systems designed for a lamp constructed in accordance with the principle of the modular solution.

This problem is solved according to the invention by a module for projecting a light beam having the characteristics defined in claim 1.

By the use of reflecting surfaces that are designed in a manner such as to operate in a predominantly converging configuration, the optical module according to the invention solves the problem of mutual interference between devices in the modular solution.

Preferred embodiments of the invention are defined in the dependent claims.

Figure 1B:
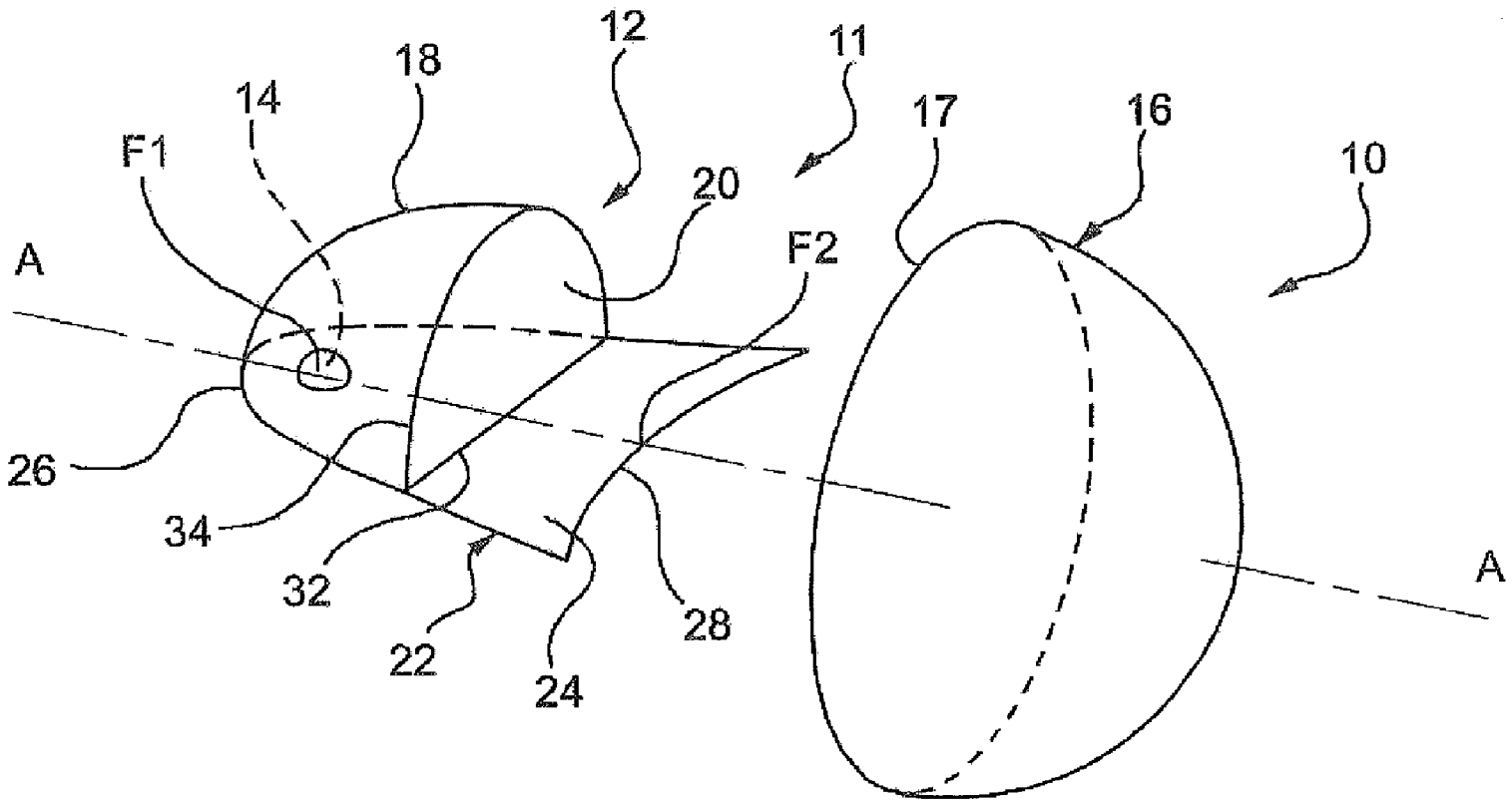
Figure 2:
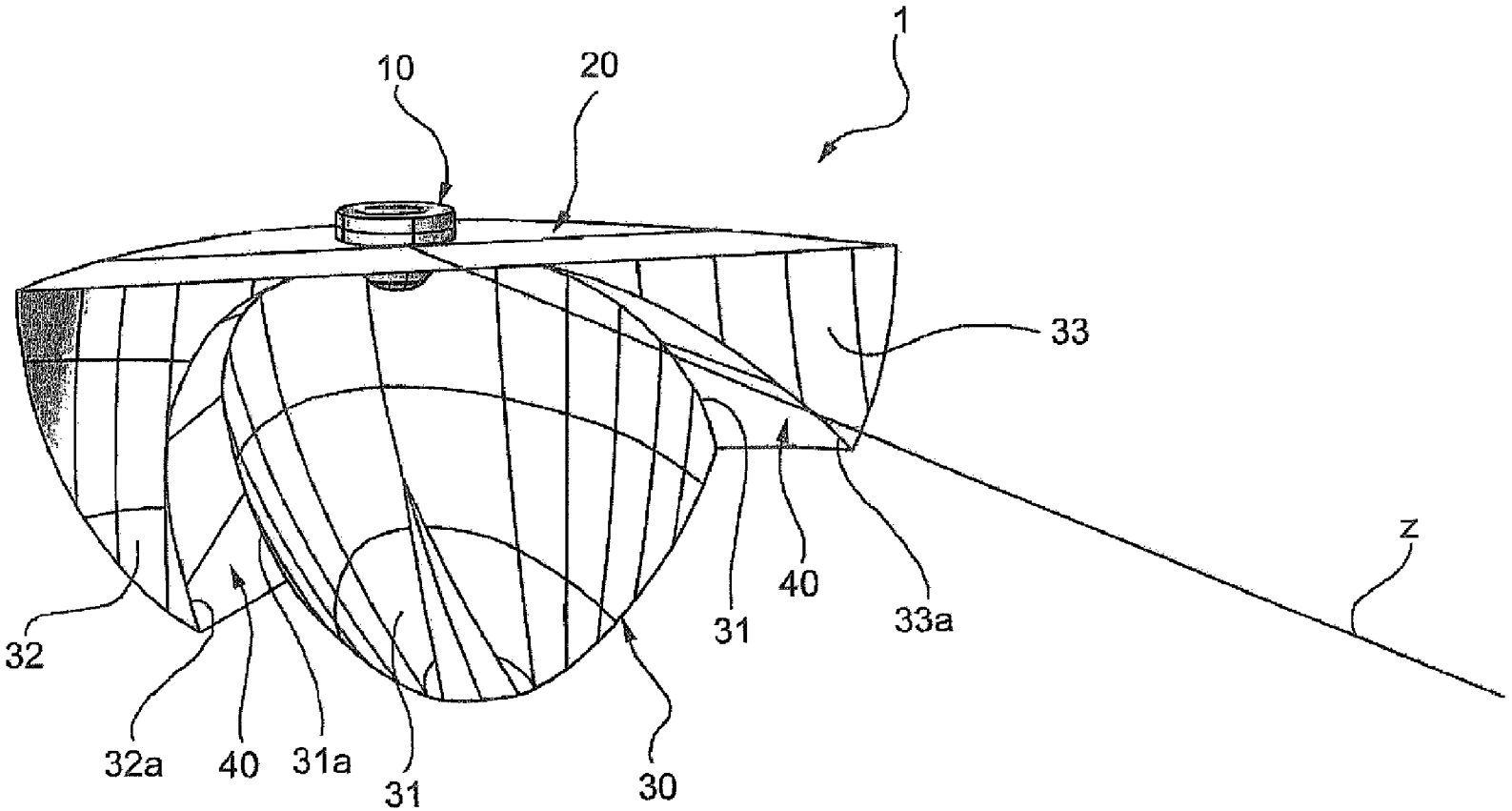
Figure 3:
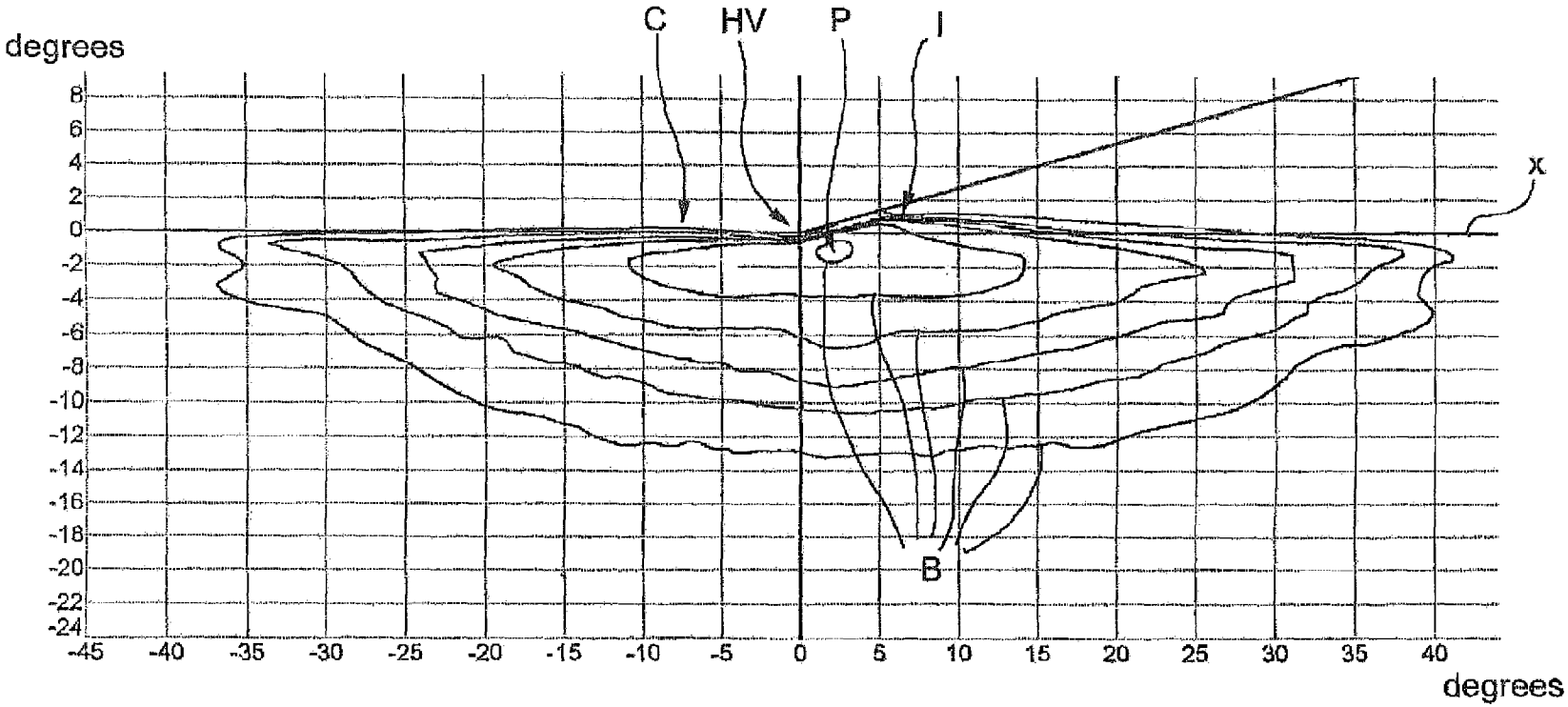
Figure 4:
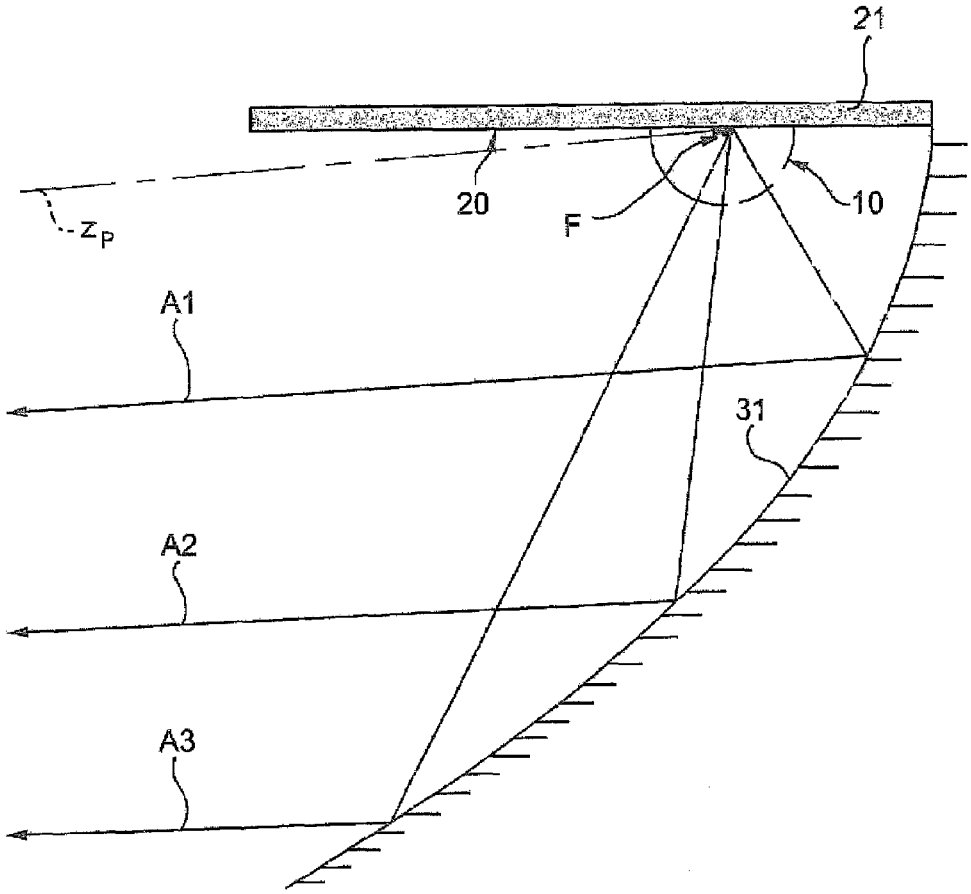
Figure 5:
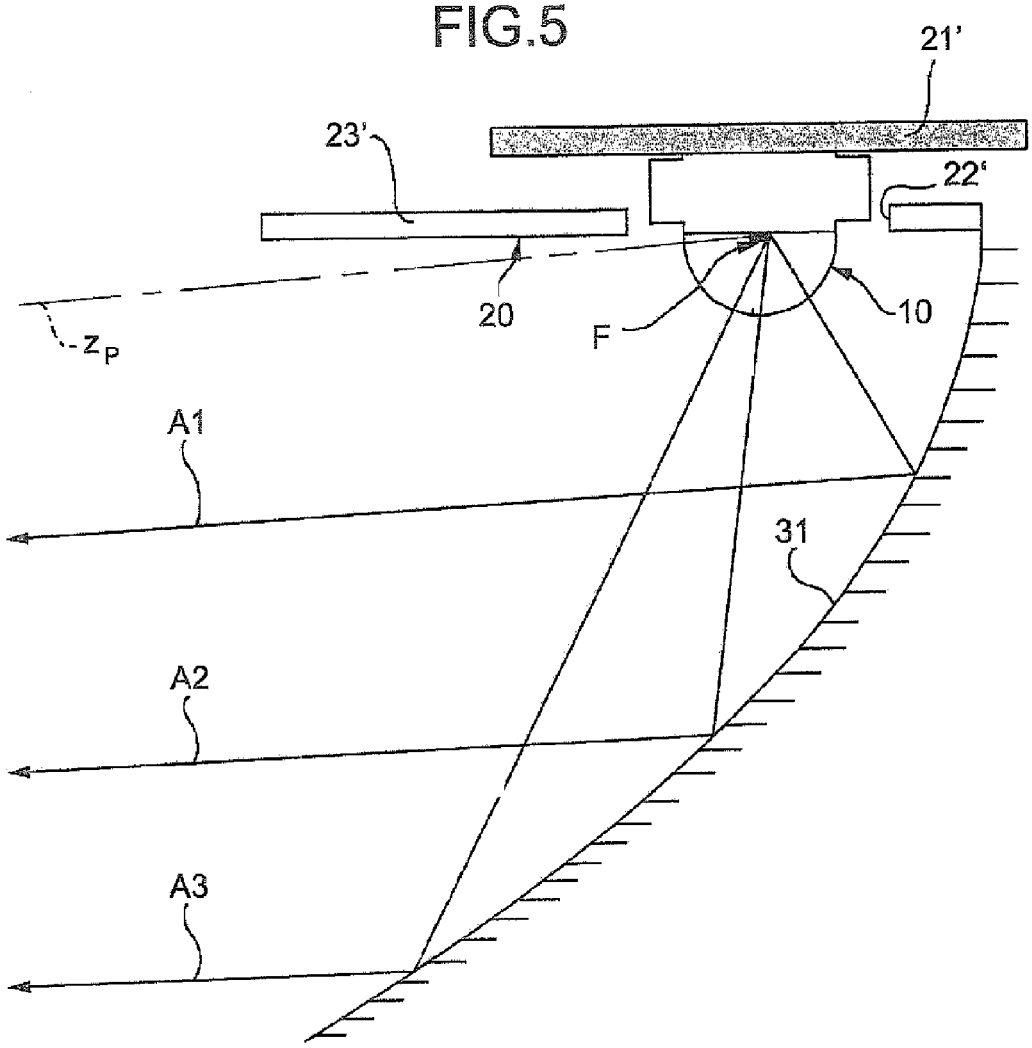
Figure 6:
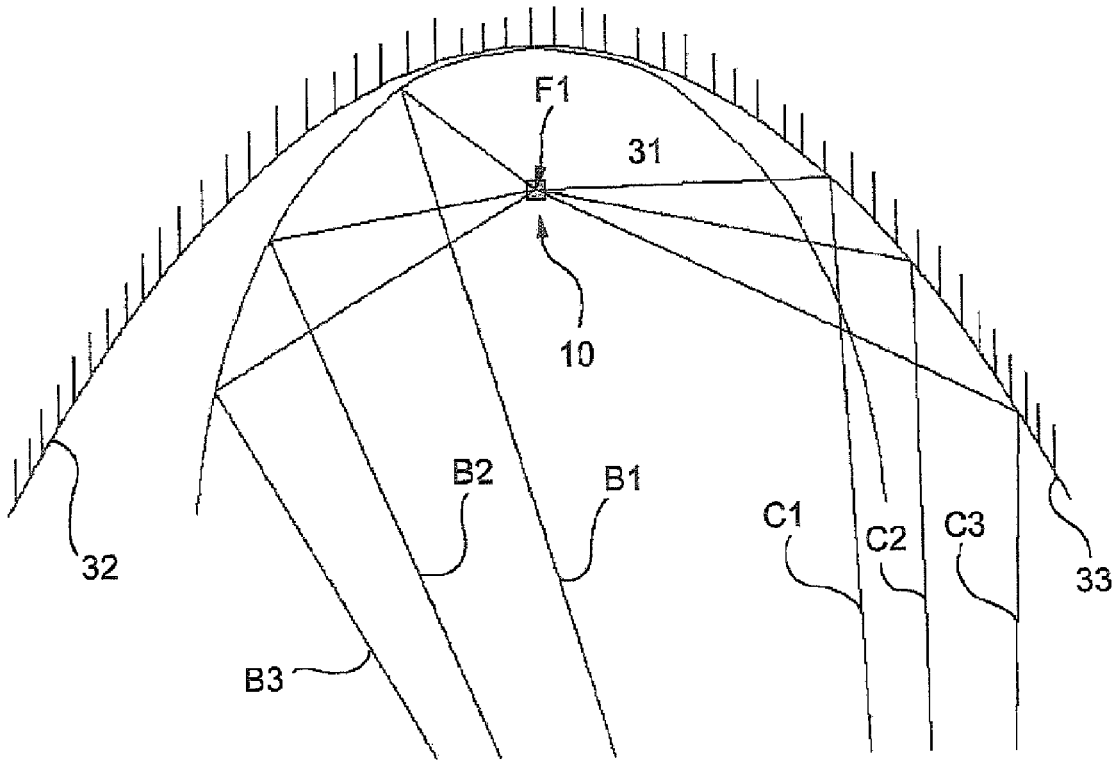
Figure 7:
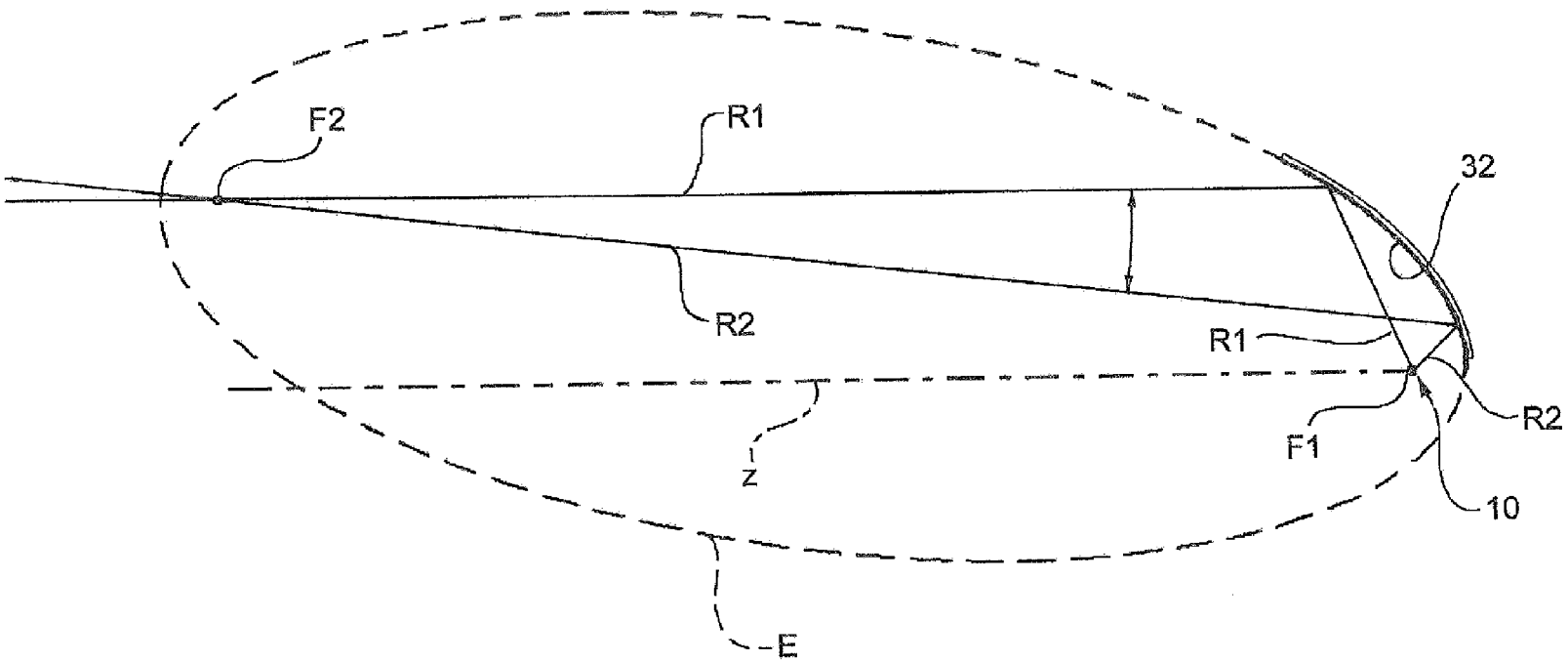
Figure 8:
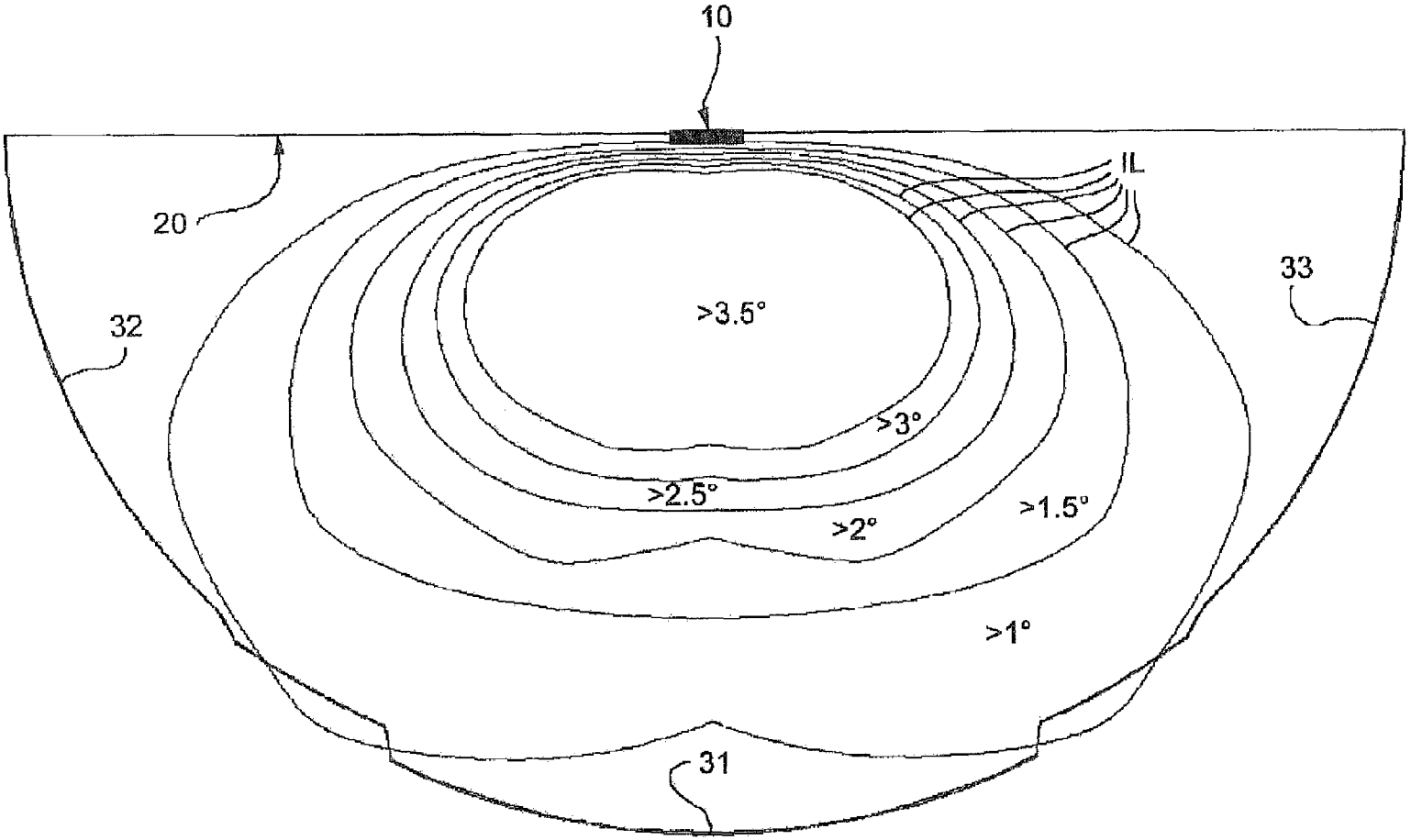
Figure 9:
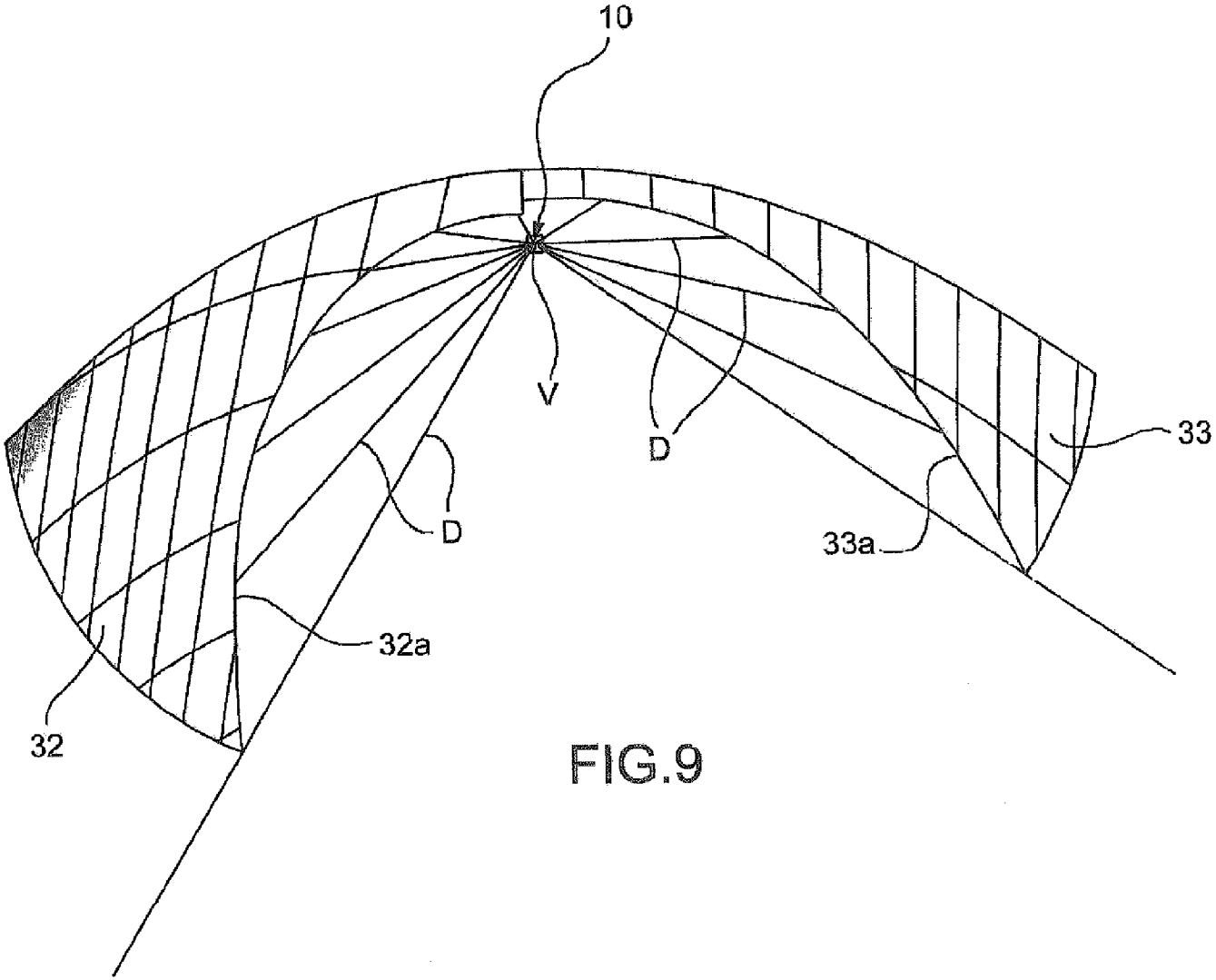
Figure 10:
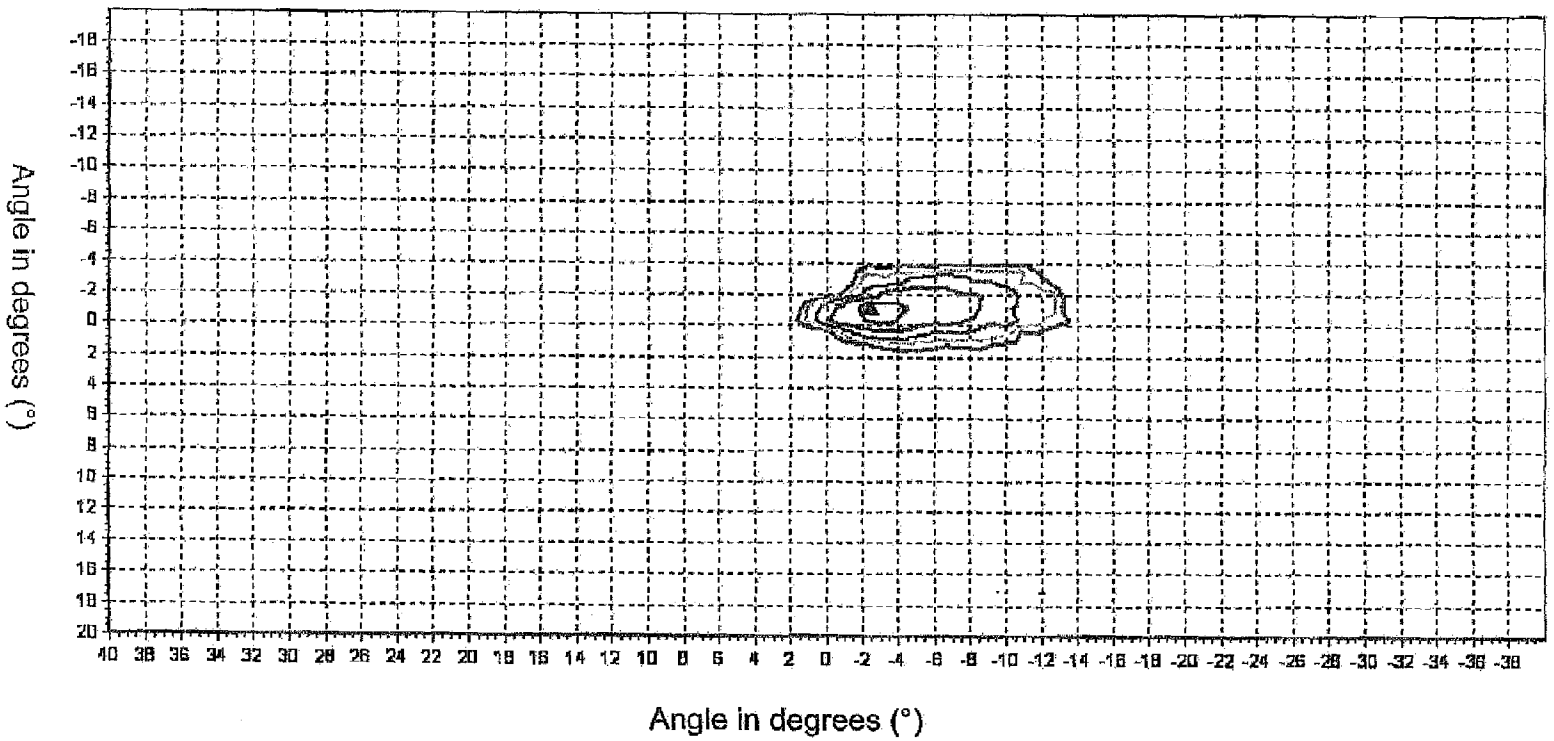
Figure 11:
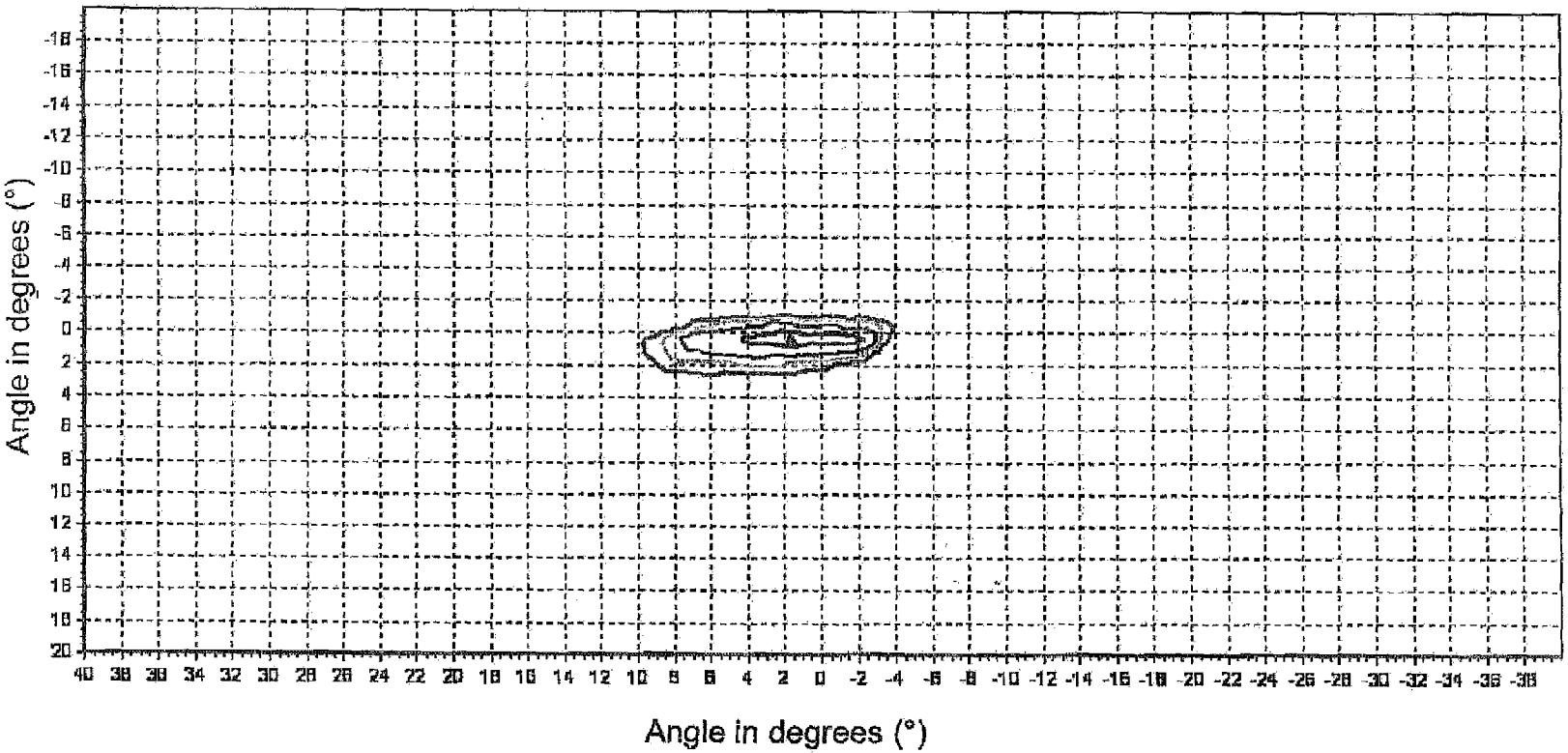
Figure 12:
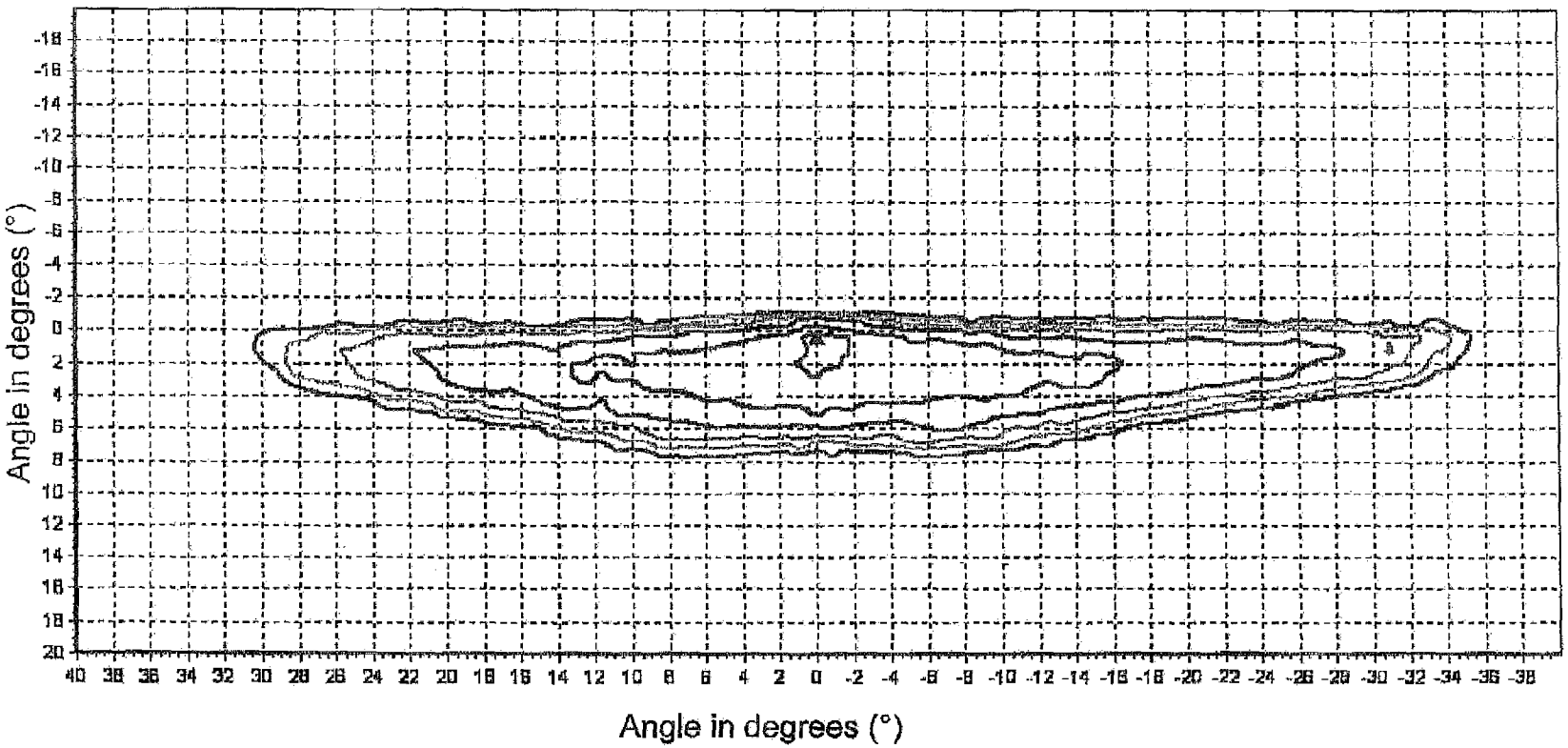
Figure 13:
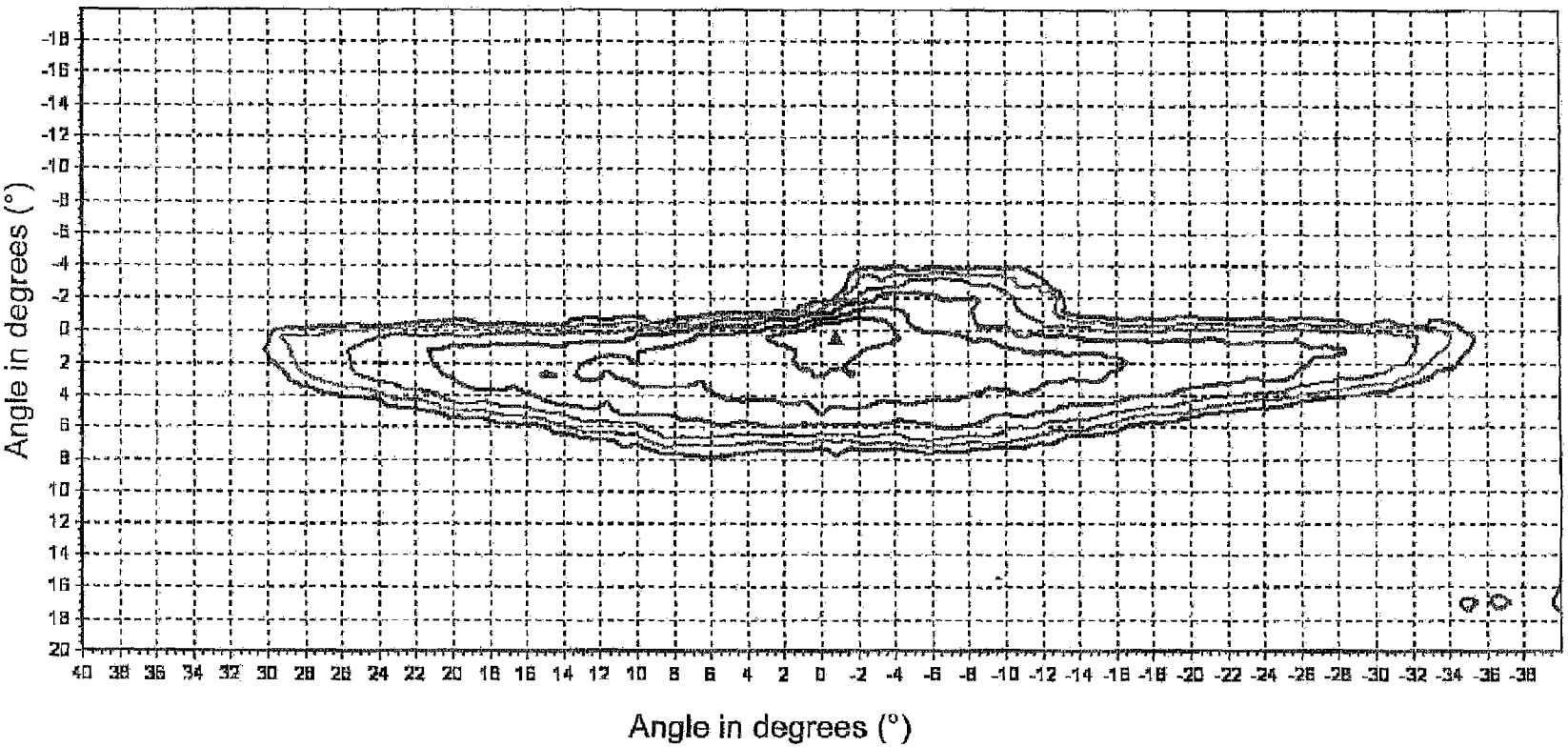

Some preferred but non-limiting embodiments of the invention will now be described with reference to the appended drawings, in which:

FIGS. 1*a*, 1*b* are schematic views of the optical chain for producing the dipped-beam pattern constituting the prior art, FIG. 2 is a schematic, perspective front view of an embodiment of a module for projecting a light beam according to the invention, FIG. 3 is a graph showing a typical pattern for the dipped-beam function of a motor-vehicle front headlamp according to the European norm, FIGS. 4 and 5 are longitudinal sections through the module of FIG. 2 showing two different variants of that module, FIG. 6 is a horizontal section through the module of FIG. 2, FIG. 7 is a schematic view which shows, in horizontal section, a possible variant of the optical arrangement of one of the surfaces of the module of FIG. 2, FIG. 8 is a front view of the module of FIG. 2 showing some curves with constant values of the vertical divergence θ of the reflected light beam, FIG. 9 is a schematic, perspective front view of some surfaces of the module of FIG. 2, FIGS. 10 to 12 show distributions of luminous intensity which can be achieved with the individual reflecting surfaces of the module of FIG. 2, FIG. 13 shows the central portion of the distribution of luminous intensity as a whole which can be achieved with the module of FIG. 2.

With reference to FIG. 2, this shows a module 1 for projecting a light beam according to the invention which is intended to form part of a set of similar modules for implementing the dipped-beam function of a motor-vehicle front headlamp (not shown). This type of use should not be considered limiting, since modules of this type can be used for other motor-vehicle front or rear lamp functions such as, for example, the fog-lamp function.

As is known, the light beam projected by a headlamp of this type in the dipped-beam (or passing-beam) function has to satisfy certain norms. For example, FIG. 3 shows a typical luminous intensity pattern which satisfies the requirements set by the European norm. This pattern is represented by a set of Cartesian axes having its origin on the optical axis of the lamp. The light distribution curves B join points of equal luminous intensity and indicate luminous intensities which increase gradually as the peak of the pattern of the system is approached.

The main critical aspect of the dipped-beam function pattern is constituted by the regions close to the horizon where the norm requires a very abrupt transition from the distribution maximum or peak P, at an angle of 1-2 degrees below the horizon, and intensity values close to zero above the horizon line. In a dipped-beam lamp according to the European norm, the luminous intensity distribution adopts the characteristic form shown in FIG. 3; the demarcation line C at the horizon is known as the cut-off line. In the European dipped beam, the cut-off line C has, on its right-hand side, an indentation I forming an angle of about 15 degrees with the axis of the horizon. This indentation is absent from the American dipped beam and is horizontally reversed in Great Britain and Japan. The transition zone HV between the substantially horizontal cut-off line C and the indentation I is generally referred to as the "HV point".

Returning to FIG. 2, the module 1 comprises:

a) a light source 10 which, in a preferred embodiment, is an LED or chipLED semiconductor source, b) a substantially flat support surface 20 on which the source 10 is arranged so as to emit light from only one side of the support surface 20, c) a curved reflecting surface 30 which extends on one side of the support surface and has its concavity facing towards the support surface, and which is capable of reflecting the light originating from the source in a direction substantially parallel to an optical axis z of the module 1, defined as the axis extending through the centre of the source and parallel to the direction of travel of the vehicle, the reflecting surface being divided into a plurality of areas, and d) a connecting surface 40 which connects at least two of the reflecting areas in a stepped manner.

FIGS. 4 and 5 are vertical sections through the module 1 which extend through the optical axis z and at right angles to the support surface 20 and show two different variants of the module 1. In the variant of FIG. 4, the support surface 20 may be the surface of a printed circuit 21 in which the source 10 is incorporated directly (for example, the source may be an LED in "chip" or "die", form, that is, in the form of a semiconductor without a package, incorporated in the printed circuit by chip-on-board type technologies). In the variant of FIG. 5, the surface of the printed circuit 21' on which the source to is incorporated and the flat support surface 20 are two distinct and parallel planes and the flat support surface 20 has a through-hole 22' such that the source 10 incorporated on the surface of the printed circuit 21' is housed inside the through-hole 22' and the principal emission plane of the source 10 substantially coincides with the flat support surface 20. In a preferred embodiment, the flat support surface 20 is also reflective.

As mentioned above, the curved reflecting surface 30 is divided into a plurality of reflecting areas. Each of the reflecting areas is designed to form a predetermined, substantially rectangular pattern, the horizontal extent of which (that is, the extent along the longer side of the substantially rectangular pattern) is determined by the horizontal divergence of the beam of rays emitted by the source 10 and reflected by that area, that is, by the angular amplitude, projected onto a horizontal plane, of the envelope of the rays emitted by the source 10 and reflected by the area. Similarly, the vertical extent of the pattern (that is, its extent along the shorter side of the substantially rectangular pattern) is determined by the vertical divergence of the beam of rays emitted by the source 10 and reflected by that area, that is, by the angular amplitude, projected onto a vertical plane, of the envelope of the rays emitted by the source 10 and reflected by the area.

When the vertical profile of the reflecting area is substantially parabolic, the vertical divergence at a given point of that area of the curved reflecting surface 30 coincides with the maximum vertical angle θ subtended by the source 10 at that point.

In a preferred embodiment, at least one of the areas is a complex surface which has a substantially parabolic vertical cross-section perpendicular to the support surface 20 and parallel to the optical axis z with an axis substantially parallel to the support surface 20 and a focus substantially coinciding with the source 10, and a substantially elliptical horizontal cross-section (perpendicular to the vertical cross-section and parallel to the flat support surface) having its primary focus F substantially coinciding with the source 10; this embodiment is characterized in that the light beam emitted by the source 10 and reflected by the area has a divergence of less than 20° in the horizontal cross-section. The horizontal cross-section may also be parabolic with its focus F substantially coinciding with the source 10 so that the divergence in the horizontal cross-section is determined solely by the extended dimension of the source 10. This area is adjacent the flat support surface 20 and extends in a direction perpendicular to the flat support surface 20 for a limited distance so that the light beam emitted by the source 10 and reflected by that area has a divergence of less than 3° in the vertical cross-section.

In a preferred embodiment, at least one other of the areas is obtained by the anticlockwise rotation, through an angle of 15° about an axis substantially parallel to the optical axis, of a complex surface which, prior to rotation, has a substantially parabolic vertical cross-section perpendicular to the support surface 20 and parallel to the optical axis z, with an axis substantially parallel to the support surface 20 and a focus substantially coinciding with the source 10, and a substantially elliptical horizontal cross-section (perpendicular to the vertical cross-section and parallel to the flat support surface) having its primary focus F substantially coinciding with the source 10; this embodiment is characterized in that the light beam emitted by the source 10 and reflected by the area has a divergence of less than 20° in the horizontal cross-section, the rotation having the purpose of rotating the substantially rectangular pattern formed by the light emitted by the source 10 and reflected by the area anticlockwise through an angle of 15°. This area is adjacent the flat support surface 20 and extends in a direction perpendicular to the flat support surface 20.

In a preferred embodiment, at least one other of the areas is a complex surface of substantially elliptical horizontal cross-section with its primary focus substantially coinciding with the source 10; this embodiment is characterized in that the light beam emitted by the source 10 and reflected by the area has a horizontal divergence greater than 50°.

In a preferred embodiment, the curved reflecting surface 30 is divided into three areas:

a) an area 32 which is adjacent the flat support surface 20 which produces a reflected beam with horizontal divergence of less than 20° and vertical divergence of less than 3°, b) an area 33 which is obtained by the anticlockwise rotation through 15° about an axis substantially parallel to the optical axis of the module, of a surface originally producing a reflected beam with horizontal divergence of less than 20° and vertical divergence of less than 3°, c) a third area 31 which is not adjacent the flat support surface 20 and which produces a beam with horizontal divergence greater than 50°, the areas being connected by the connecting surface described below.

FIG. 6 is a horizontal cross-section parallel to the support surface 20 and extending through the source 10, of the module 1 in the embodiment in which the lateral area 32 has an elliptical horizontal cross-section and the lateral area 33 is obtained by the rotation, through 15° about an axis substantially parallel to the optical axis z, of a surface with an elliptical horizontal cross-section. The elliptical horizontal cross-section of the central reflecting area 31 and the horizontal cross-sections of the lateral reflecting areas 32, 33 each having a respective one of its foci, indicated F1, substantially coinciding with the source 10 can be seen in this drawing. This drawing also shows the rays indicated B1, B2, B3, which are reflected by the central area 31 and which are oriented towards the secondary focus (not visible) of the ellipse that defines the central area 31, as well as the rays, indicated C1, C2, C3, which are reflected by the lateral area 33 and which are oriented towards the secondary focus (not visible) of the ellipse which defines the original surface of the lateral area 33. The lateral reflecting areas 32 and 33 are designed in a manner such that the respective portions of the light beam generated by the source 10 that are reflected thereby have a horizontal divergence less than a predetermined angular value. This angular value is preferably 20°.

FIG. 7 shows a variant of the module 1. FIG. 7 shows, in horizontal cross-section, one of the lateral reflecting areas, indicated 32, in the embodiment in which the lateral area 32 has an elliptical horizontal cross-section. In this drawing, it can be seen that the area 32 is constituted, in horizontal cross-section, by a portion of an ellipse E having its primary focus F1 coinciding with the source 10. It can also be seen that the secondary focus F2 of the ellipse E is outside the optical axis z of the module 1. This arrangement is necessary if the pattern produced by the beam reflected by the reflecting area 32 is to be displaced horizontally relative to the arrangement in which the focus F2 lies on the optical axis z. This arrangement is also applicable to the original surface the rotation of which produces the area that produces the portion of the pattern coinciding with the indentation in this case, in addition to the rotation through 15° about an axis substantially parallel to the optical axis, a rotation about an axis substantially perpendicular to the former axis and parallel to the support surface 20 may be required.

The lateral reflecting areas 32 preferably extend in a direction perpendicular to the flat support surface 20 for a distance such that the portion of the light beam emitted by the source 10 and respectively reflected by the area 32 has a vertical divergence θ of less than 3°. As can be seen from FIG. 8, to establish the shapes of the lateral reflecting areas 32, it is possible to make use of a mapping of the lines with constant θ, also known as isospread lines, on the reflecting surface 30, as described in the Applicant's application EP 1 505 339 A1, which is incorporated herein by reference. FIG. 8 shows an example of these isospread lines, which are indicated IL. The height of the lateral reflecting area 33 may be comparable to the height of the lateral reflecting area 32.

The central reflecting area 31 is designed in a manner such that the portion of the light beam that is produced by the source 10 and reflected by that area 31 has a horizontal divergence greater than a predetermined angular value. This angular value is preferably 50°.

With reference to FIGS. 2 and 9, the connecting surface 40 is constituted by a portion of a conical surface obtained as the locus of the straight lines which have a common vertex V coinciding with the source 10 and lie on curves defined by edge portions 31*a*, 32*a* and 33*a* of the reflecting areas 31, 32 and 33, respectively. In other words, the lower edges 32*a* and 33*a* of the lateral reflecting areas 32 and 33 define portions of a directrix of the substantially conical surface which has its vertex V at the source 10 and a portion of which is constituted by the connecting surface 40. This is shown more clearly in FIG. 9 which shows, in addition to the lateral reflecting areas 32 and 33, also the generatrices D of the substantially conical surface on which the connecting surface 40 is defined. The upper edge 31*a* of the central reflecting area 31 also lies on the substantially conical surface having its vertex at V. The connecting surface 40 is thus delimited, in the direction of the generatrices D, by the upper edge 31*a* of the central reflecting area 31 on one side and by the lower edges 32*a* and 33*a* of the lateral reflecting surfaces 32 and 33 on the other side.

The connecting surface 40 between the central area 31 and the lateral areas 32 and 33 is thus constructed so as to comply with two requirements:

a. not to be illuminated directly by the light emitted by the source 10, in order to minimize spurious reflections, b. to maximize the amount of light falling on the lateral areas 32 and 33 farthest from the source 10.

According to a variant of the invention, the connecting surface 40 may in any case be reflective.

In a preferred embodiment, the module is intended for forming the pattern for the dipped-beam pattern. As mentioned above, that pattern is characterized by a divergence of the projected beam which is particularly critical for the regions of the lamp which project the light towards the distribution zone close to the horizon where the norm requires a very abrupt transition from the distribution maximum or peak, which is situated at an angle of 1-2 degrees below the horizon, to intensity values close to zero above the horizon line; the demarcation line at the horizon is known as the cut-off line. In the European dipped beam, the cut-off line has, on the right-hand side, an indentation forming an angle of about 15 degrees with the axis of the horizon. This indentation is absent from the American dipped beam and is reversed horizontally in UK and Japan. In a preferred embodiment relating to the dipped-beam function with approval, for example, in Europe, UK or Japan, one of the two areas 32, 33 characterized by vertical divergence of less than 3° is dedicated to the formation of the portion of the "cut-off" line which is inclined to the horizon, and the other of the two areas 32, 33 characterized by vertical divergence of less than 3° is dedicated to the formation of the portion of the pattern comprising the so-called HV point and the distribution intensity peak, whilst the third area 31 is dedicated to the remaining portion of the pattern. The light distribution as a whole produced by the module 1 is shown in FIG. 13.

As stated, the curved reflecting surface 30 is composed of a plurality of reflecting areas 31, 32, 33. The reflecting areas 31 and 32 have a substantially parabolic vertical cross-section; the reflecting area 33 is produced by the anticlockwise rotation through 15° of a surface originally characterized by a substantially parabolic vertical cross-section.

In a preferred embodiment, to ensure the formation of a clear horizontal line of separation between the illuminated region and the dark region which is typical of the dipped-beam pattern, the curved reflecting surface 30 is positioned in the half space defined by the flat support surface 20 and facing towards the road surface and the perimeter of the source 10 is substantially tangential to a straight line extending through the focus F of the parabola and perpendicular to the optical axis z so that the light source 10 is positioned entirely in the half plane that is defined by the straight line and contains the vertex of the parabola.

In another preferred embodiment, to ensure the formation of a clear horizontal line of separation between the illuminated region and the dark region which is typical of the dipped-beam pattern, the curved reflecting surface 30 is positioned in the half space defined by the flat support surface 20 and facing away from the road surface and the perimeter of the source 10 is substantially tangential to a straight line extending through the focus F of the parabola and perpendicular to the optical axis z so that the source 10 is positioned entirely in the half plane that is defined by the straight line and does not contain the vertex of the parabola.

In a further preferred embodiment, the "direct" light, that is the light that is emitted directly by the source 10 and does not fall on the curved reflecting surface 30 or on the flat support surface 20, is masked by means of a suitable, substantially absorbent mask; the shape and dimensions of the mask are such that the mask blocks exclusively the direct light, that is, the outline of the shadow produced by the mask coincides with the edge of the outlet opening of the reflector, the outlet opening being defined as the section through which the light rays reflected by the curved reflecting surface 30 emerge. The mask is fixed to the flat support surface 20 in the immediate vicinity of the source 10 so that the fraction of the light reflected by the curved reflecting surface 30 which falls on the mask is minimized.

The embodiments described herein are intended to be considered as examples of the implementation of the invention; the invention may, however, be modified with regard to the shape and arrangement of parts and constructional and operational details in accordance with the many possible variants which will appear suitable to persons skilled in the art.

The invention claimed is:

1. A module for projecting a light beam, comprising:

a light source suitable for producing the light beam, a substantially flat support surface on which the source is arranged in such a way as to emit the light beam from only one side of the flat support surface, and a curved reflecting surface which extends on one side of the flat support surface and has its concavity facing towards the flat support surface, and which reflects the light beam originating from the source in a principal direction substantially parallel to the flat support surface of the source, the reflecting surface being divided into a plurality of reflecting areas suitable for receiving respective portions of the light beam, wherein the plurality of reflecting areas comprises at least one central reflecting area and at least one first lateral reflecting area, the central reflecting area being interposed between the light source and the first lateral reflecting area and having a substantially elliptical horizontal cross-section parallel to the flat support surface with one of its foci substantially coinciding with the light source, and a substantially parabolic vertical cross-section with an axis substantially parallel to the fiat support surface and with its focus substantially coinciding with the light source, and wherein the central reflecting area and the first lateral reflecting area are geometrically configured in such a way that the portion of the light beam reflected by the first lateral reflecting area is substantially collimated in a vertical direction and has a small horizontal spread $\alpha$ less than a first predetermined angular value $\alpha_1$, and that the portion of the light beam reflected by the central reflecting area has a wide horizontal spread $\alpha$ greater than a second predetermined angular value $\alpha_2$.

2. A module according to claim 1, comprising at least one second lateral reflecting area which has a small horizontal spread less than a predetermined angular value $\alpha_1$ so that the portion of the light beam emitted by the light source and reflected by that second lateral reflecting area contributes to the formation of the indentation of a dipped-beam pattern.

3. A module according to claim 2 in which the first predetermined angular value $\alpha_1$ is 20° and the second predetermined angular value $\alpha_2$ is 50°.

4. A module according to claim 3, further comprising a connecting surface which connects at least two of the reflecting areas in a stepped manner, the connecting surface being constituted by a portion of a substantially conical surface obtained as the locus of the straight lines which have a common vertex substantially coinciding with the light source and lie on curves defined by edge portions of the reflecting areas.

5. A module according to claim 4 in which the connecting surface is reflective.

6. A module according to claim 5 in which the first and second lateral reflecting areas are adjacent the flat support surface and on opposite sides of the optical axis of the module, and the central reflecting area is remote from the flat support surface, the connecting surface connecting the central reflecting area to the lateral reflecting areas.

7. A module according to claim 6 in which the lateral reflecting areas have a substantially elliptical horizontal cross-section parallel to the support surface with one focus thereof substantially coinciding with the light source.

8. A module according to claim 7 in which the secondary focus of the horizontal cross-section of at least one of the reflecting areas is outside the optical axis of the module.

9. A module according to claim 8 in which the lateral reflecting area which reflects a substantially vertically collimated beam is designed so as to form a region of the dipped-beam illumination pattern around an HV point and a peak of that pattern, whereas the central reflecting area is designed to cover the remaining portion of the dipped-beam illumination pattern.

10. A module according to claim 1 in which the flat support surface is reflective.

11. A module according to claim 10, wherein a substantially absorbent mask is also provided for masking the light that is coming directly from the light source without having been reflected by the curved reflecting surface or by the flat support surface.

12. A module according to claim 1, wherein the curved reflecting surface is positioned below the flat support surface, and the perimeter of the light source is substantially tangential to a straight line that extends through the focus of the parabola constituting the vertical cross-section of the curved reflecting surface and is perpendicular to the optical axis of the module so that the light source is positioned entirely in the half plane that is defined by the straight line and contains the vertex of the parabola.

13. A module according to claim 1, wherein the curved reflecting surface is positioned above the flat support surface and the perimeter of the source is substantially tangential to a straight line that extends through the focus of the parabola constituting the vertical cross-section of the curved reflecting surface and is perpendicular to the optical axis of the module so that the light source is positioned entirely in the half plane that is defined by the straight line and does not contain the vertex of the parabola.

14. A module according to claim 1 in which the source is disposed on the support surface and the flat support surface is the surface of a printed circuit in which the source is directly incorporated.

15. A module according to claim 1 in which the light source is incorporated on the surface of a printed circuit, the surface of the printed circuit and the flat support surface are two distinct and parallel planes, and the flat support surface has a through-hole such that the source incorporated on the surface of the printed circuit is housed inside the hole and the principal emission plane of the source substantially coincides with the flat support surface.

16. A module according to claim 1 in which the light source is a semiconductor source, preferably an LED or chip LED.

17. A module according to claim 1 in which at least one portion of the flat support surface is coloured in such a way as to produce chromatic effects with aesthetic content when the light source is switched off.

* * * * *